US012600524B2

(12) United States Patent
Mayer

(10) Patent No.: US 12,600,524 B2
(45) Date of Patent: Apr. 14, 2026

(54) DRINK CONTAINER AND METHOD OF MAKING AND USING SAME

(71) Applicant: Juergen Mayer, Bad Waldsee (DE)

(72) Inventor: Juergen Mayer, Bad Waldsee (DE)

(73) Assignee: VERALLIA PACKAGING SAS, Courbevole (FR)

( * ) Notice: Subject to any disclaimer, the term of this patent is extended or adjusted under 35 U.S.C. 154(b) by 64 days.

(21) Appl. No.: 18/442,338

(22) Filed: Feb. 15, 2024

(65) Prior Publication Data

US 2024/0286796 A1 Aug. 29, 2024

(30) Foreign Application Priority Data

Feb. 23, 2023 (DE) ..... 202023100854.2

(51) Int. Cl.
*B65D 23/00* (2006.01)

(52) U.S. Cl.
CPC ..... *B65D 23/00* (2013.01); *B65D 2203/00* (2013.01)

(58) Field of Classification Search
CPC .... B65D 81/32; B65D 85/804; B65D 85/816; A47J 43/27
See application file for complete search history.

(56) References Cited

U.S. PATENT DOCUMENTS 1,774,328 A * 8/1930 Huff ..... B26B 17/02 30/182
4,039,435 A * 8/1977 Narva ..... B65D 85/816 206/217
6,159,513 A * 12/2000 Judlowe ..... B65D 55/0818 426/115
8,225,956 B1 * 7/2012 LeBlanc ..... A47J 43/27 206/459.1
2015/0056332 A1 * 2/2015 Gold ..... A23L 2/52 426/112
2019/0375581 A1 * 12/2019 Vo ..... B65D 85/804

* cited by examiner

*Primary Examiner* — Timothy P. Kelly
(74) *Attorney, Agent, or Firm* — Andrew Wilford

(57) ABSTRACT

A container body has a lower body part and an upper body part separated by a visible marking. The lower part only is filled with a body of a liquid substantially up to the marking while leaving the upper part liquid-free and the upper part is closed by a cap. For subsequent consumption of the liquid, the cap is removed and then an additive fluid is added to the liquid in the body an additive and mixed therewith before consumption of the liquid.

12 Claims, 1 Drawing Sheet

DRINK CONTAINER AND METHOD OF MAKING AND USING SAME

FIELD OF THE INVENTION

The present invention relates to a drink container. More particularly this invention concerns such a drinking cup having a cup body and a removable cover and to a method of making and using the container.

BACKGROUND OF THE INVENTION

A typical drink container comprises a cup body and that is closed by a cap and that holds a body of comestible liquid. Such a container has been common for many decades.

OBJECTS OF THE INVENTION

It is therefore an object of the present invention to provide an improved drink container way that hold different beverages and/or drinks that are particularly tasty when consumed shortly after being mixed from two components.

SUMMARY OF THE INVENTION

This object is attained according to the invention in that the bottle of the drink container has a lower bottle part and an upper bottle part separated from one another by a visible marking. The interior of the lower bottle part is filled with a comestible liquid up to the visible marking and the interior of the upper bottle part above the visible marking is free of liquid when the bottle is capped. After removing the cap of the bottle, the interior of the upper bottle part can be filled with an additive fluid, normally a liquid. The additive liquid can be mixed with the liquid in the bottle. The mixture of the liquid and the additive fluid can then be consumed as a drink by the consumer from the bottle. It is possible to add different additive fluids to the upper bottle part of the bottle of the drink container, whereby different beverages can be consumed from one and the same bottle.

Conveniently, the visible marking is at a position on the bottle that divides the bottle into the lower bottle part and the upper bottle part according to the specified mixing ratio between the liquid and the additive fluid.

The marking is advantageously fixed to the bottle and in fact is formed in one piece with the bottle. The marking can usefully be a circumferential annular projection or a circumferential annular groove each formed on the outer surface of the at least partially transparent bottle. Alternatively, the marking can be formed by the transition between two differently shaped bottle parts, for example between a cylindrical lower bottle part and a frustoconical upper bottle part.

Furthermore, it is possible to form the marking by changing the outer surface design of the bottle, whereby the color and/or the structure of the outer surface of the marking can be changed.

In addition, embodiments of the drink container according to the invention are also possible in which the marking can be fixed at different positions on the bottle so that the mixing ratio between the liquid and the added liquid can be changed. In this case, the marking can be adjusted between different positions on the bottle.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION OF THE INVENTION

Figure 1:
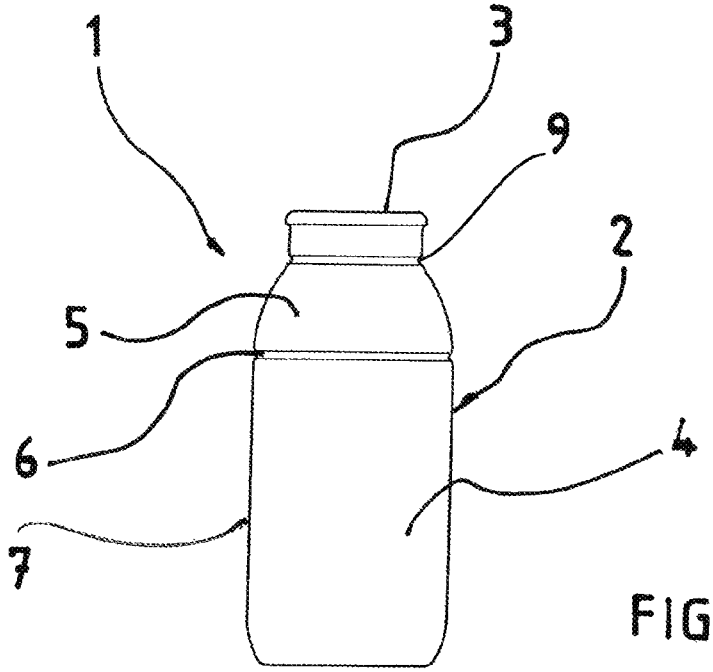
FIG. 1 is side elevation view of a drink container according to the invention.

As seen in the drawing a drink container 1 has a body 2 that contains a comestible liquid. The container body 2 of the drink container 1 is closed or can be closed by a cap 3.

The container body 2 of the drink container 1 shown in FIG. 1 is divided into a cylindrical lower body part 4 and an upwardly tapering and generally frustoconical upper body part 5. In the embodiment of the drink container 1 according to the invention shown in FIG. 1, a marking 6 is formed between the lower body part 4 and the upper body part 5. The marking 6 visually separates the lower body part 4 and the upper body part 5 from each other. In the embodiment shown in FIG. 1, the marking 6 is formed as an outwardly open annular groove that runs in a plane around an outer surface 7 of the container body 2. Alternatively, the marking 6 can also be designed as an annular outwardly projecting ridge, as a circumferential arrangement of discrete bumps, or the like.

In the drink container 1 according to the invention, the container body 2 or its lower body part 4 is filled with a comestible liquid up to but not upward past the marking 6. Accordingly, the interior of the lower body part 4 is filled with the liquid after the filling process. In contrast, the interior of the upper body part 5 remains free of liquid. Before the liquid in the container body 2 of the drink container 1 is consumed as a beverage, an additive liquid is poured through the container mouth into or added to the liquid-free upper body part 5 after removing the cap 3 of the container body 2. This additive mixes with the liquid in the lower body part 4 of the container body 2. Mixing is best done by putting the cap 3 back on and shaking the container 1. The mixture of the liquid in the lower body part 4 and the liquid added to the upper body part 5 can be consumed as a beverage from the container body 2.

The visible marking 6 is on the outer surface 7 of the container body such that the container body 2 is divided into the lower body part 4 and the upper body part 5 by the visible marking 6 in accordance with the predeterminable or predetermined mixing ratio between the already in the container hand and the liquid to be added. In the embodiment of the drink container 1 shown in FIG. 1, the marking 6 is formed in a fixed position on the container body 2, namely by the annular groove formed integrally with the container body 2 on the outer surface 7 of the container body 2.

In addition the body 4 of the container has an upper marking/formation 9 formed like the marking/formation 6 as an outwardly open groove and spaced above the marking 6. This marking 9 indicates an upper level to which the additive is to be added, which is somewhat below the actual mouth of the body part 7 not shown in FIG. 1 because it is underneath the cap 3. Thus the user can add the additive, which is typically a liquid like a flavor juice, to the level of the upper marking 9 after removing the cap 3, then replace the cap 3 and shake the bottle. The small air space left above the marking 9 gives some room for the liquid contents to move and mix.

Figure 2:
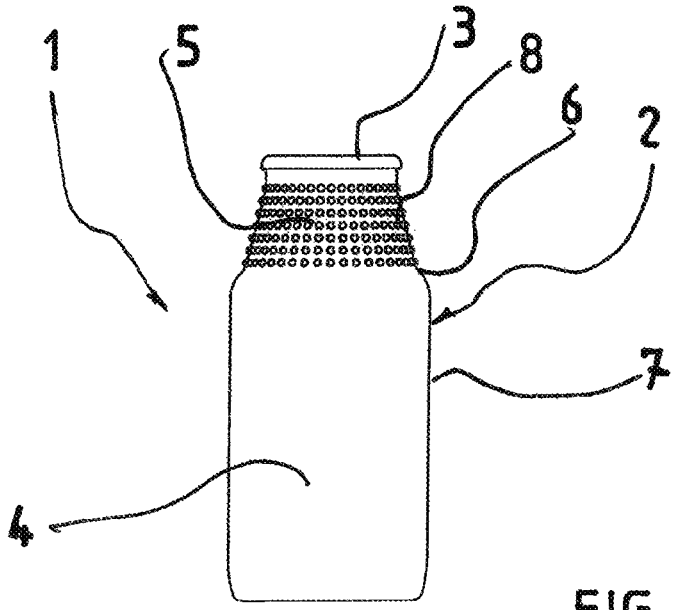
FIG. 2 is another such view of another embodiment of the inventive drink container.

In the embodiment of the drink container according to the invention shown in FIG. 2, the marking 6 is realized by the transition between the two differently shaped body parts 4, 5. This is the lower body part 4, which is essentially cylindrical in the embodiment of the drink container 1 shown in FIG. 2, and the upper body part 5, which is generally frustoconical in the embodiment of the drink container 1 shown in FIGS. 1 and 2. The marking 6 on the outer surface of the container body 2 of the drink container 1 shown in FIG. 2 is emphasized even more clearly by the fact that there is a change in the outer surface design of the container body 2 at the marking 6. Here, the upper body part 5 has a large number of outwardly projecting bumps 8 on its outer surface, whereas the outer surface of the lower part 4 of the container body 2 is smooth. Due to the large number of bumps 8, the container body has a different surface structure in the area of the upper body part 5 than in the area of the lower body part 4, and the marking 6 is the transition between the surface structures. In the FIG. 2 container, the upper row of bumps 8, which lie in a plane perpendicular to an axis of the body serve as the upper marking.

Alternatively, the marking 6 can also be a coloring the outer surface of the container body 2 differently in the area of the lower body part 4 than in the area of the upper body part 5.

Instead of a stationary fixation of the marking 6 on the container body 2, solutions can also be provided in which a marking can be moved between different positions on the container body and fixed in these different positions to indicate different fill ratios between the liquid and the additive.

I claim:

1. A method comprising the steps of sequentially:

providing a container having a lower part and an upper part separated by a visible marking consisting of a visibly or haptically perceptible change in an outer surface of the container;

partially filling the lower part with a body of a liquid substantially only up to the marking while leaving the upper part liquid-free;

closing the partially filled container with a cap;

for subsequent consumption of the liquid, removing the cap;

adding to the liquid in the container an additive fluid miscible with the liquid; and mixing the fluid and the liquid.

2. The method according to claim 1, the change in the outer surface of the container is a visible marking at a position of the container subdividing the container into the lower part and the upper part according to a predetermined mixing ratio between the liquid and the additive fluid.

3. The method according to claim 1, wherein the change in the outer surface of the container is fixed on the container.

4. The method according to claim 3, wherein the change in the outer surface of the container is formed integrally with the container.

5. The method according to claim 4, wherein the change in the outer surface of the container is formed as a circumferential ring of annular bumps or as a circumferential annular groove on the outer surface of the container.

6. The method according to claim 3, wherein the lower part is substantially cylindrical and the upper part is generally frustoconical.

7. The method according to claim 6, wherein the change in the outer surface of the container is formed by a transition between the parts.

8. The method according to claim 3, wherein the change in the outer surface of the container is formed by a change in color and/or the structure of the outer surface of the parts.

9. The method according to claim 1, wherein the change in the outer surface of the container is at a plurality of different positions on the container.

10. The method according to claim 1, wherein the change in the outer surface of the container is movable between a plurality of different positions on the container.

11. The method according to claim 1, wherein the additive fluid is a liquid, the method further comprising the steps of:

providing the container with an upper marking above the change in the outer surface of the container between the upper and lower parts and below an upwardly open mouth of the container; and adding the additive only up to a level at the upper marking before mixing the additive and the liquid.

12. The method according to claim 11, further comprising the step of:

reinstalling the cap atop the container after adding the additive and before mixing the additive liquid with the liquid already in the container.

* * * * *